US007808305B2

(12) United States Patent
Kim et al.

(10) Patent No.: US 7,808,305 B2
(45) Date of Patent: Oct. 5, 2010

(54) LOW-VOLTAGE BAND-GAP REFERENCE VOLTAGE BIAS CIRCUIT

(75) Inventors: Young Ho Kim, Daejeon (KR); Seong Soo Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 11/945,708

(22) Filed: Nov. 27, 2007

(65) Prior Publication Data

US 2008/0136504 A1 Jun. 12, 2008

(30) Foreign Application Priority Data

Dec. 7, 2006 (KR) ..... 10-2006-0123884

(51) Int. Cl.
*G05F 1/10* (2006.01)
*G05F 3/02* (2006.01)

(52) U.S. Cl. ..... 327/539; 327/538

(58) Field of Classification Search ..... 327/538–543
See application file for complete search history.

(56) References Cited

U.S. PATENT DOCUMENTS

| | | | | |
|---|---|---|---|---|
| 4,375,598 | A * | 3/1983 | Sakai | 327/72 |
| 4,820,967 | A | 4/1989 | Kertis et al. | |
| 6,788,041 | B2 | 9/2004 | Gheorghe et al. | |
| 6,795,343 | B2 | 9/2004 | Marotta et al. | |
| 6,828,847 | B1 | 12/2004 | Marinca | |
| 6,879,141 | B1 * | 4/2005 | Ho | 323/315 |
| 6,995,587 | B2 * | 2/2006 | Xi | 327/77 |

FOREIGN PATENT DOCUMENTS

| | | |
|---|---|---|
| JP | 06-309051 | 11/1994 |
| JP | 2005-128939 | 5/2005 |
| JP | 2006-065439 | 3/2006 |
| KR | 1019940023014 | 10/1994 |

(Continued)

OTHER PUBLICATIONS

Yeong-Tsair Lin, et al; "A Low Voltage CMOS Bandgap Reference;" IEEE-NEWCAS Conference, 2005. The 3rd International 19-22 2005, pp. 227-230.

(Continued)

*Primary Examiner*—Lincoln Donovan
*Assistant Examiner*—Daniel Rojas
(74) *Attorney, Agent, or Firm*—Ladas & Parry LLP

(57) ABSTRACT

A low-voltage band-gap reference voltage bias circuit is provided. In the low-voltage band-gap reference voltage bias circuit, a proportional-to-absolute temperature (PTAT) current is copied to two nodes, respectively, to generate a first voltage having a negative slope with respect to temperature variation, and a second voltage having a positive slope with respect to temperature variation, and first and second elements having high impedances are serially connected to each other between the two nodes, such that the sum of the negative slope of the first voltage and the positive slope of the second voltage is zero and an average voltage between the two nodes is extracted to output the extracted result as a reference voltage. Accordingly, a stable reference voltage of 1V or lower regardless of a power supply voltage and temperature variation can be supplied.

8 Claims, 5 Drawing Sheets

FOREIGN PATENT DOCUMENTS

| | | |
|---|---|---|
| KR | 1999-0005917 | 1/1999 |
| KR | 2019990011564 | 3/1999 |
| KR | 1020000043624 | 7/2000 |
| KR | 1020010010741 | 2/2001 |
| KR | 1020040004023 | 1/2004 |
| KR | 1020060053414 | 5/2006 |
| WO | WO 98/48334 | 10/1998 |

OTHER PUBLICATIONS

Ming-Dou Ker, et al; "New Curvature-Compensation Technique for CMOS Bandgap Reference with Sub-1-V Operation;" Circuits and systems II: Express Briefs, IEEE Transactions on Digital Signal Processing, vol. 53, Issue 8, Aug. 2006 pp. 667-671.

* cited by examiner

LOW-VOLTAGE BAND-GAP REFERENCE VOLTAGE BIAS CIRCUIT

CROSS-REFERENCE TO RELATED APPLICATION

This application claims priority to and the benefit of Korean Patent Application No. 2006-123884, filed Dec. 7, 2006, the disclosure of which is incorporated herein by reference in its entirety.

BACKGROUND

1. Field of the Invention

The present invention relates to a low-voltage band-gap reference voltage bias circuit and, more specifically, to a low-voltage band-gap reference voltage bias circuit that is unaffected by temperature, power supply voltage, and variation in process in semiconductor bias circuit technology and can supply a stable reference voltage at a supply voltage of 1V or lower. The present invention has been produced from the work supported by the IT R&D program of MIC (Ministry of Information and Communication)/IITA (Institute for Information Technology Advancement) [2005-S017-02, Integrated Development of UltraLow Power RF/HW/SW SoC] in Korea.

2. Discussion of Related Art

Generally, Radio-Frequency (RF) circuits, analog mixed circuits or digital circuits that are fabricated as chips require stable and precise reference bias voltages in order to perform efficient operations.

However, reference bias voltages provided in a conventional bias circuit are apt to change over time due to a variation in temperature during the operation of the bias circuit.

In order to solve the above-described problem, a band-gap reference voltage bias circuit has been employed. The band-gap bias circuit provides stable reference voltages by using a temperature characteristic of a bipolar transistor (or a diode) under the conditions of any variation of temperature.

$$V_{ref}=\alpha_1 V_1+\alpha_2 V_2\approx\alpha_1 V_{BE}+\alpha_2\Delta V_{BE} \quad \text{(Equation 1)}$$

In Equation 1, a voltage V1 has a characteristic that is proportional to temperature, while a voltage V2 has a characteristic that is inversely proportional to temperature. In this case, when a zero-temperature coefficient obtained by selecting appropriate values such that the sum of the characteristics of the two voltages V1 and V2 satisfies an equation $\alpha_1\partial V_1/\partial T+\alpha_2\partial V_2/\partial T=0$, a reference voltage $V_{ref}$ is independent of any variation of temperature.

FIG. 1 is a circuit diagram of a conventional CMOS band-gap reference voltage bias circuit. A base-emitter voltage of a bipolar transistor is inversely proportional to temperature, while a base-emitter voltage difference $\Delta V_{BE}$ between first and second bipolar transistors Q1 and Q2 having different amounts of current is proportional to temperature. Voltages (i.e. $\Delta V_{BE}$) applied to both ends of the first resistor R1 are amplified by the feedback amplifier AMP. In this case, a current supplied to the first resistor R1 is $\Delta V_{BE}$/R1. The current $\Delta V_{BE}$/R1 copies the characteristic of the base-emitter voltage difference $\Delta V_{BE}$ and is mirrored to the third PMOS transistor M3.

While a mirrored current $I_3$ flows through the second resistor R2 and the third bipolar transistor Q3 as expressed by Equation 2. Equation 2 is a numerical expression of a band-gap reference voltage that can counteract a temperature coefficient. In this case, a coefficient k having an inverse temperature slope to the base-emitter voltage $V_{BE3}$ of the third bipolar transistor Q3 is controlled by using a resistance ratio R2/R1 in order to obtain exact temperature compensation.

$$V_{ref}\approx V_{BE3}+\frac{R_2}{R_1}\Delta V_{BE}\approx V_{BE3}+k\cdot V_T\ln n\approx 1.25\,\text{V} \quad \text{(Equation 2)}$$

However, since the conventional band-gap reference voltage bias circuit has a complete temperature compensation characteristic (i.e., a zero-temperature coefficient) at about 1.25 V as expressed by Equation 2, this bias circuit cannot be applied to circuit configurations having a sub-1V supply voltage.

In the mobile communication handsets, it is most important to design small-area low-power core chips in order to ensure high portability and durability. The development of deep sub-micron CMOS technology enables the small-area low-power (or low-voltage) core chips to be manufactured. However, even if a low supply voltage is applied to meet the low-power design specification, since a conventional band-gap bias circuit requires an operating voltage of at least 1.5 V or higher, it is difficult to design a small-area and low-power chip using the conventional band-gap bias circuit.

SUMMARY OF THE INVENTION

The present invention relates to the low-supply voltage band-gap reference voltage bias circuit, which can provide stable reference voltages at an operating voltage of 1V or lower irrespective of a power supply voltage or temperature variation. Moreover, it has a simple configuration and occupies a small layout area.

The purpose of the present invention provides a low-supply voltage band-gap reference voltage bias circuit including: first and second PMOS transistors having gate terminals commonly coupled to a first node, source terminals commonly coupled to a power supply terminal, and drain terminals respectively coupled to second and third nodes, and constituting a current mirror circuit; third and fourth PMOS transistors having gate terminals commonly coupled to the first node, source terminals commonly coupled to the power supply terminal, and drain terminals respectively coupled to fourth and fifth nodes; a feedback amplifier having a non-inverting input terminal and an inverting input terminal respectively coupled to the second and third nodes and an output terminal coupled to the first node; a first resistor coupled between the third node and a sixth node; a second resistor coupled between the fifth node and a ground terminal; first through third bipolar transistors having emitters respectively coupled to the second, sixth, and fourth nodes and collectors and bases that are grounded; and first and second elements coupled in series between the fourth and fifth nodes, and having high impedances to cut off the flow of current to obtain an average of voltages at the fourth and fifth nodes, wherein the average of the voltages at the fourth and fifth nodes is used as a reference voltage.

Another purpose of the present invention provides a low-supply voltage band-gap reference voltage bias circuit including: first and second PMOS transistors having gate terminals commonly coupled to a first node, source terminals commonly coupled to a power supply terminal, and drain terminals respectively coupled to second and third nodes, and constituting a current mirror circuit; third and fourth PMOS transistors having gate terminals commonly coupled to the first node, source terminals commonly coupled to the power supply terminal, and drain terminals respectively coupled to fourth and fifth nodes; a feedback amplifier having a non-inverting input terminal and an inverting input terminal respectively coupled to the second and third nodes and an output terminal coupled to the first node; a first resistor coupled between the third node and a sixth node; a second resistor coupled between the fourth node and a ground terminal; a first diode coupled between the second node and the ground terminal; a second diode coupled between the sixth node and the ground terminal; a third diode coupled between the fifth node and the ground terminal; and first and second elements coupled in series between the fourth and fifth nodes, and having high impedances to cut off the flow of current to obtain an average of voltages at the fourth and fifth nodes, wherein the average of the voltages at the fourth and fifth nodes is used as a reference voltage.

Each of the first and second elements may be a diode.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EMBODIMENTS

Now, the present invention will be described more fully hereinafter with reference to the accompanying drawings, in which exemplary embodiments of the invention are shown. This invention may, however, be embodied in different forms and should not be construed as limited to the embodiments set forth herein. Rather, these embodiments are provided so that this disclosure is thorough and complete, and fully conveys the scope of the invention to those skilled in the art.

Figure 1:
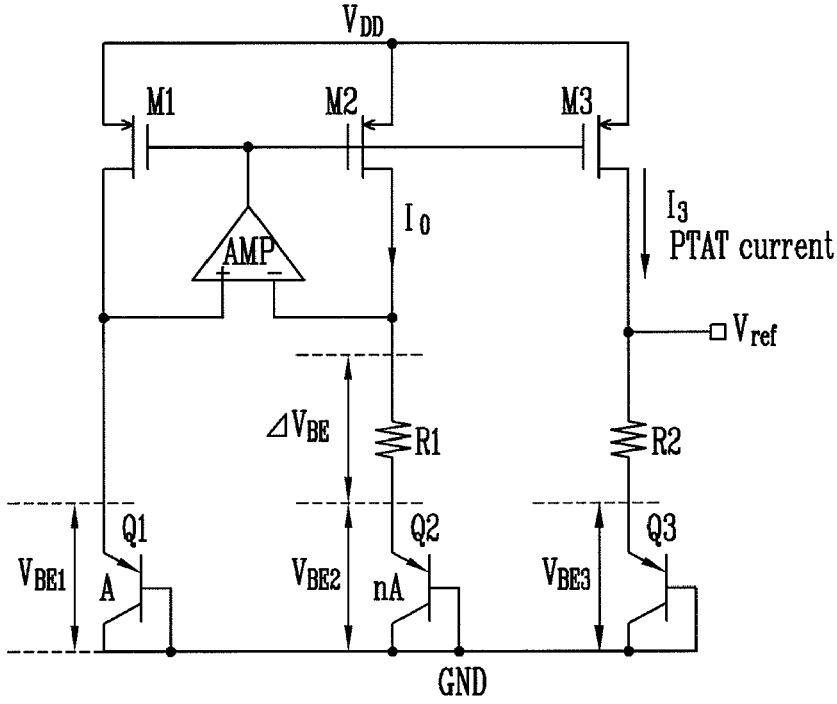
FIG. 1 (PRIOR ART)
FIG. 1 is a circuit diagram of a conventional CMOS band-gap reference voltage bias circuit.
Figure 2:
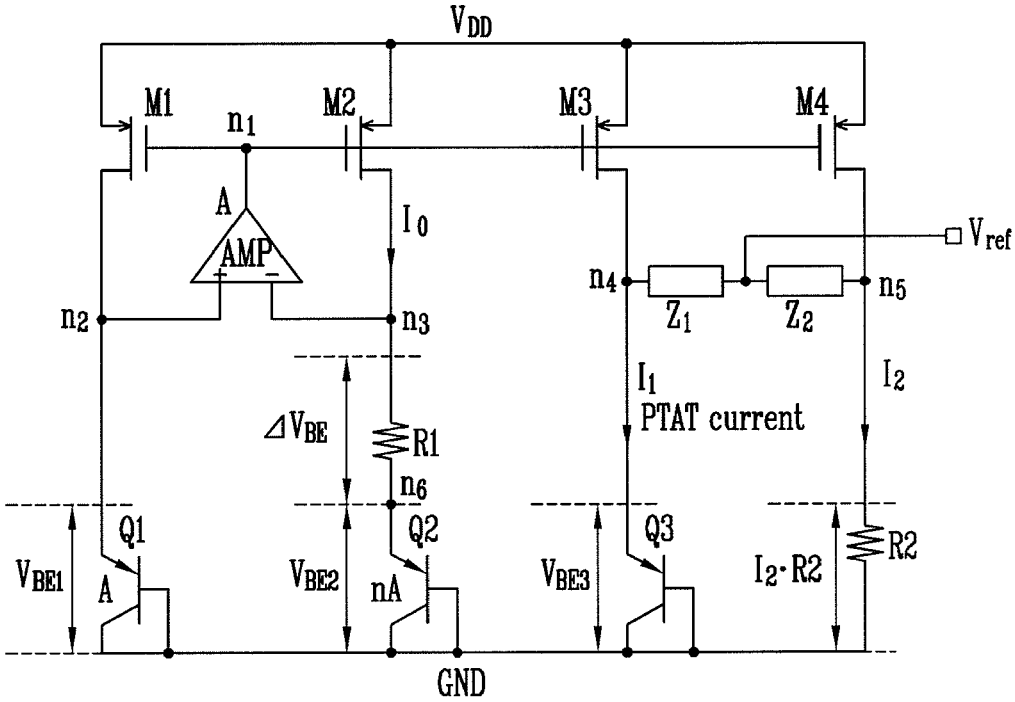
FIG. 2 is a circuit diagram of a low-voltage band-gap reference voltage bias circuit according to an exemplary embodiment of the present invention.

FIG. 2 is a circuit diagram of a low-voltage band-gap reference voltage bias circuit according to an exemplary embodiment of the present invention.

Referring to FIG. 2, the low-voltage band-gap reference voltage bias circuit according to the exemplary embodiment of the present invention includes first through fourth PMOS transistors M1 to M4, a feedback amplifier AMP, first and second resistors R1 and R2, first through third bipolar transistors Q1 to Q3, and first and second elements Z1 and Z2 having high impedance.

Here, since the first and second PMOS transistors M1 and M2 constitute a current mirror circuit, the first and second PMOS transistors M1 and M2 have gate terminals commonly coupled to a first node $n_1$, source terminals commonly coupled to a power supply terminal Vdd, and drain terminals respectively coupled to second and third nodes $n_2$ and $n_3$.

The third and fourth PMOS transistors M3 and M4 have gate terminals commonly coupled to the first node $n_1$, source terminals commonly coupled to a power supply terminal Vdd, and drain terminals respectively coupled to fourth and fifth nodes $n_4$ and $n_5$.

The feedback amplifier AMP includes a non-inverting input terminal + and an inverting input terminal −, which are respectively coupled to the second and third nodes $n_2$ and $n_3$, and an output terminal, which is coupled to the first node $n_1$.

The first resistor R1 is coupled between the third node $n_3$ and a sixth node $n_6$, and the second resistor R2 is coupled between the fifth node $n_5$ and a ground terminal GND.

The first through third bipolar transistors Q1 to Q3 have emitter terminals, which are respectively coupled to the second, sixth, and fourth nodes $n_2$, $n_6$, and $n_4$, and collectors and bases, which are grounded.

The first and second elements Z1 and Z2 are coupled in series between the fourth and fifth nodes $n_4$ and $n_5$, and a reference voltage $V_{ref}$ terminal is coupled between the first and second elements Z1 and Z2.

Figure 4:
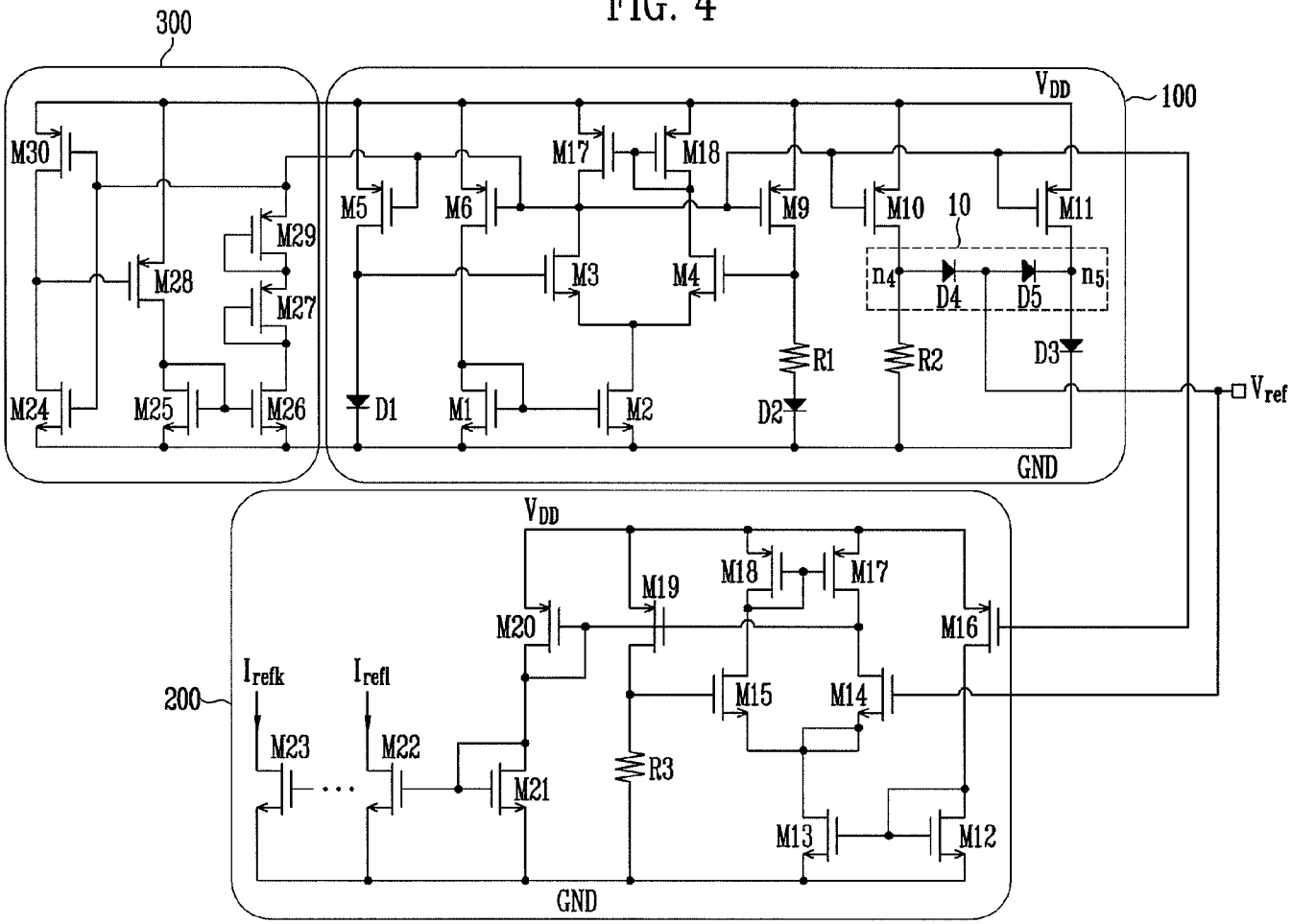
FIG. 4 is a detailed circuit diagram of the band-gap bias power supply shown in FIG. 3.

Meanwhile, the first and second bipolar transistors Q1 and Q2 and the second resistor R2 may be replaced by diodes and the third bipolar transistor Q3 may be replaced by a resistor as illustrated in FIG. 4.

Hereinafter, the operations of the above-described low-voltage band-gap reference voltage bias circuit according to the exemplary embodiment of the present invention will be described in detail.

To begin, in order to obtain the characteristics of a base-emitter voltage difference $\Delta V_{BE}$ and a proportional-to-absolute temperature (PTAT) current, a circuit is configured using first and second PMOS transistors M1 and M2, a feedback amplifier AMP, first and second bipolar transistors Q1 and Q2, and a first resistor R1.

As described above, the feedback amplifier AMP coupled to the first and second PMOS transistors M1 and M2 equalizes voltages $V_{BE1}$ and $V_{BE2}$+VR1 at both input terminals. A voltage VR1 applied to both ends of the first resistor R1 is equal to the base-emitter voltage difference $\Delta V_{BE}$ between the first and second bipolar transistors Q1 and Q2 (i.e., $\Delta V_{BE}=V_{BE1}-V_{BE2}$).

The voltage VR1 varies in proportion to a temperature. In this case, current $\Delta V_{BE}$/R1 flowing through the first resistor R1 copies proportional currents $I_1$ and $I_2$ to the third and fourth PMOS transistors M3 and M4 through the current mirror circuit including the second PMOS transistor having a long channel length and the feedback amplifier AMP.

Also, since bias current flowing through the first and second bipolar transistors Q1 and Q2 is absolutely proportional to an absolute temperature, the mirrored currents $I_1$ and $I_2$ are also absolute-temperature proportional currents that are unaffected by a variation of power supply voltage $V_{DD}$.

The mirrored current $I_1$ of the third PMOS transistor M3 is supplied to the third bipolar transistor Q3, so that a voltage $V_{BE3}$ is applied to the third bipolar transistor Q3. Also, the mirrored current $I_2$ of the fourth PMOS transistor M4 is supplied to the second resistor R2, so that a voltage $I_2 \cdot V_{BE3}$ is applied to the second resistor R2.

In order to attain the object of the present invention, the first and second elements Z1 and Z2, each having high impedance, are inserted in series between the fourth and fifth nodes $n_4$ and $n_5$. The average voltage between the fourth and fifth nodes $n_4$ and $n_5$ (i.e. a numerical expression of a reference voltage $V_{ref}$) can be obtained as expressed by Equation 3.

$$V_{ref} \approx (V_{BE3} + I_2 \cdot R_2)/2 \approx \left(V_{BE3} + \frac{R_2}{R_1}\Delta V_{BE}\right)\Big/2 \quad \text{(Equation 3)}$$

In order to obtain a temperature compensation characteristic restricting a voltage variation within a range of less than 1% at a complete operating temperature of −40 to 120° C., it is necessary to tune the widths of the first and second PMOS transistors M1 and M2, a ratio of the resistance of the second resistor R2 to the resistance of the first resistor R1, and the areas of the first through third bipolar transistors Q1 to Q3.

A zero-temperature coefficient, which is independent of a temperature, can be obtained at an optimum tuning point. Further, the reference voltage $V_{ref}$ is also independent of a variation of the power supply voltage $V_{DD}$. Also, the reference voltage $V_{ref}$ is almost half of the conventional band-gap reference voltage. Since the proposed invention is structurally small the limitation for the voltage head-room, the band-gap reference voltage bias circuit can operate efficiently even at a supply voltage of about 1 V or lower.

In conclusion, the present invention can provide a stable reference voltage $V_{ref}$ at a supply voltage of about 1V or lower by flowing a PTAT mirror current into diodes and resistors and obtaining the average of voltages at two nodes.

In other words, a bipolar transistor voltage $V_{BE}$ (or a diode voltage $V_D$), which is inversely proportional to a temperature, and a base-emitter voltage difference $\Delta V_{BE}$ between the first and second bipolar transistors Q1 and Q2 (or a voltage difference $\Delta V_D$ between two diodes), which is proportional to the temperature, are obtained according to the band-gap theory, and the average $(k1 \cdot V_{BE} + k2 \cdot \Delta V_{BE})/2)$ of the two voltages $V_{BE}$ and $\Delta V_{BE}$ is obtained and used as the reference voltage $V_{ref}$.

In this case, a temperature coefficient may be adjusted to zero using a coefficient ratio of $k_1$ to $k_2$.

Also, in order to obtain a PTAT characteristic irrespective of a variation of the power supply voltage $V_{DD}$, the base-emitter voltage difference $\Delta V_{BE}$ between the first and second bipolar transistors Q1 and Q2 is primarily converted into current, and voltages $k1 \cdot V_{BE}$ and $k2 \cdot \Delta V_{BE}$ at the two nodes are secondarily obtained using the current.

Figure 3:
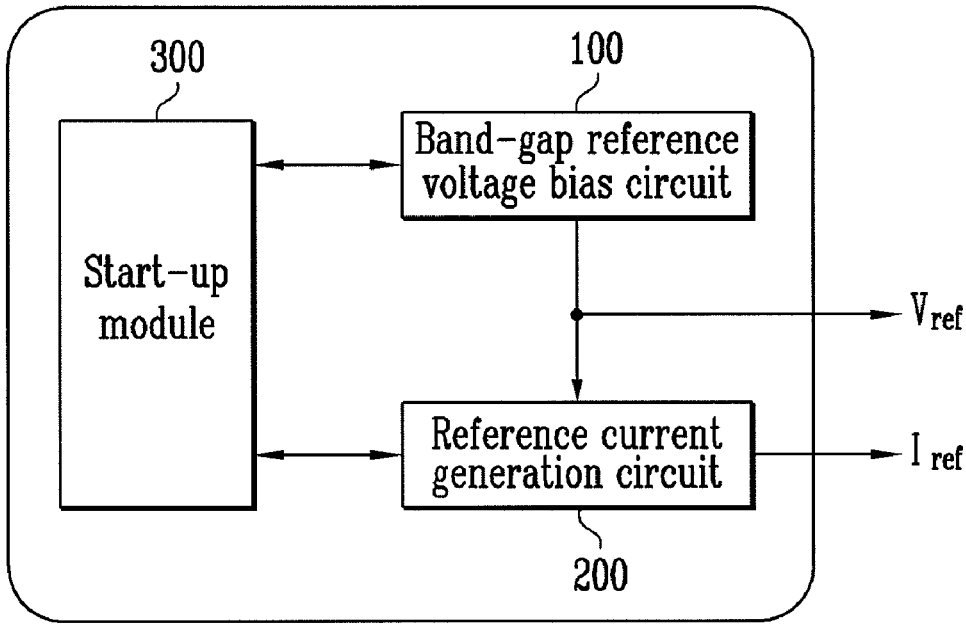
FIG. 3 is a block diagram of a band-gap bias power supply using the low-voltage band-gap reference voltage bias circuit according to an exemplary embodiment of the present invention.

FIG. 3 is a block diagram of a low-voltage band-gap reference voltage bias circuit according to an exemplary embodiment of the present invention.

Referring to FIG. 3, the band-gap bias power supply includes a band-gap reference voltage bias circuit 100, a reference current generation circuit 200, and a start-up module 300. Specifically, the band-gap reference voltage bias circuit 100 generates a reference voltage $V_{ref}$ according to the band-gap theory. The reference current generation circuit 200 generates a reference current $I_{ref}$ based on the reference voltage $V_{ref}$ generated by the band-gap reference voltage bias circuit 100. Also, the start-up module 300 provides an initial operating point of the band-gap reference voltage bias circuit 100 such that the band-gap reference voltage bias circuit 100 and the reference current generation circuit 200 escape from an abnormal zero state and reach a normal state to apply a stable bias voltage in a short amount of time.

FIG. 4 is a detailed circuit diagram of the band-gap power supply shown in FIG. 3, which includes the sub-1V low-voltage band-gap reference voltage bias circuit shown in FIG. 2.

Referring to FIG. 4, the band-gap reference voltage bias circuit 100 for generating the reference voltage $V_{ref}$ includes first through eleventh transistors M1 to M11, first through fifth diodes D1 to D5, and first and second resistors R1 and R2. The reference current generation circuit 200 for generating the reference current $I_{ref}$ includes twelfth to twenty-third transistors M12 to M23 and a third resistor R3.

The start-up module 300 for restoring the initial state of the band-gap reference voltage bias circuit to a normal state includes twenty-fourth to thirtieth transistors M24 to M30.

Since the reference current generation circuit 200 and the start-up module 300 are irrelevant to the present invention, a description thereof will not be presented here. As described above with reference to FIG. 2, the first and second elements Z1 and Z2, each having high impedance, are inserted between the fourth and fifth nodes $n_4$ and $n_5$ so that the flow of current therebetween is cut off, and the average of voltages at the fourth and fifth nodes $n_4$ and $n_5$ is obtained. However, assuming that a resistor is used in a portion 10 of FIG. 4, the resistor should have high resistance to cut off the flow of current. In this case, a large chip area is undesirable.

However, when the fourth and fifth diodes D4 and D5 are coupled in series between the two nodes $n_4$ and $n_5$, only a small chip area is needed and the flow of current that affects a temperature is cut off, so that the average of the voltages at the two nodes $n_4$ and $n_5$ can be easily obtained.

In this case, each of the diodes D4 and D5 may have the minimum area in order to reduce the entire chip area. Also, when a voltage difference between the diodes D4 and D5 is larger than $2V_{Do}$ (about 2×0.6V), a multiple number of diodes should be used in order to prevent the diodes from being turned on. However, a voltage difference between the diodes D4 and D5 is normally smaller than $2V_{Do}$ in an operating temperature range of −40 to 120° C. at a supply voltage of about 1 V or lower.

Figure 5A:
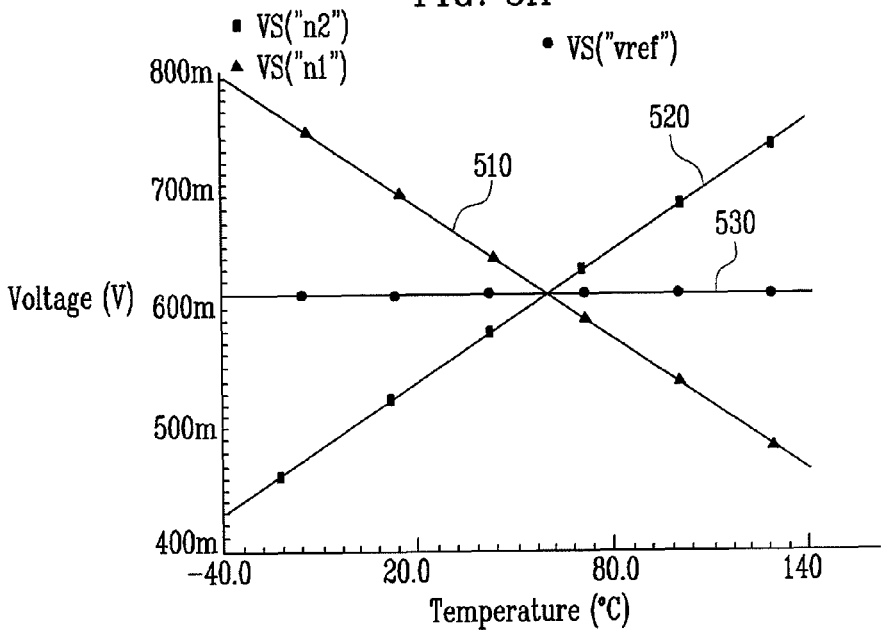
FIG. 5A is a graph showing simulation results of reference voltage according to temperature in the band-gap bias power supply shown in FIG. 4.
Figure 5B:
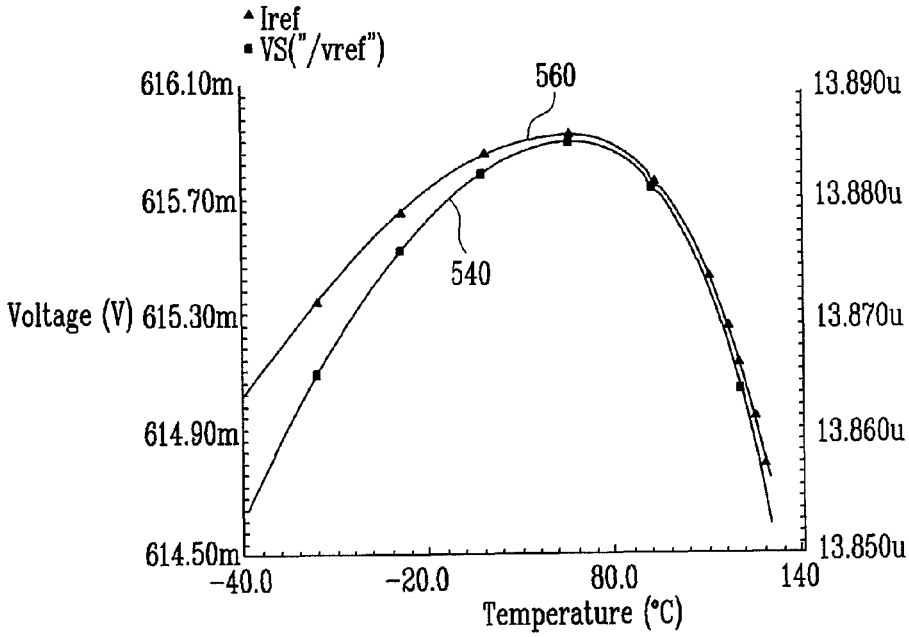
FIG. 5B is a graph showing simulation results of reference voltage and reference current according to temperature in the band-gap bias power supply shown in FIG. 4.
Figure 5C:
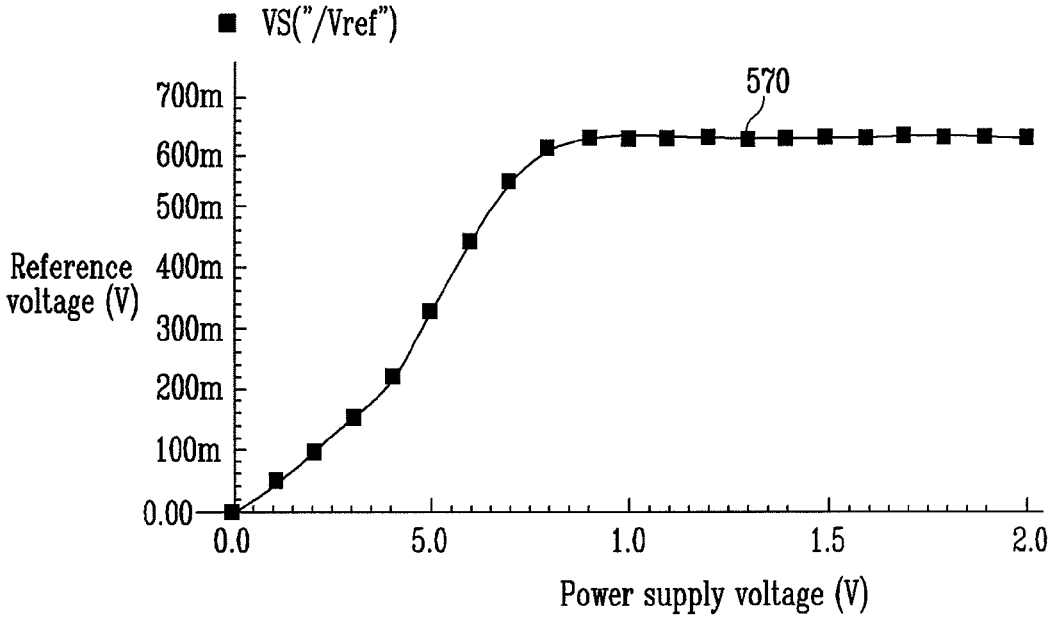
FIG. 5C is a graph showing simulation result of reference voltage according to power supply voltage in the band-gap bias power supply shown in FIG. 4.

FIGS. 5A through 5C are graphs of simulation results using the band-gap bias power supply shown in FIG. 4. Specifically, FIG. 5A is a graph showing simulation results of reference voltage according to temperature, FIG. 5B is a graph showing simulation results of reference voltage and reference current according to temperature, and FIG. 5C is a graph showing simulation results of reference voltage according to power supply voltage.

FIG. 5A illustrates voltages 510 and 520 at the two nodes, i.e., the fourth and fifth nodes $n_4$ and $n_5$, and a reference voltage 530 with respect to a temperature. The reference voltage 530 corresponds to an average of the two voltages 510 and 520 at the fourth and fifth nodes $n_4$ and $n_5$ and has a temperature compensation characteristic.

FIG. 5B illustrates a reference voltage 540 and a reference current 560 with respect to a temperature. Since both the reference voltage 540 and the reference current 560 vary within a range of 1% or less according to a temperature at a temperature of about −40 to 130° C., the band-gap reference voltage bias circuit shown in FIG. 4 may perform appropriate operations.

Referring to FIG. 5C, it can be seen that the band-gap reference voltage bias circuit shown in FIG. 4 can perform appropriate operations even at a minimum supply voltage of about 0.85 V.

According to the present invention as explained thus far, a reference voltage is reduced to 1 V or lower so that the low-voltage band-gap reference voltage bias circuit can operate at a low supply voltage. Furthermore, the low-voltage band-gap reference voltage bias circuit has simple configuration, reduces the resistance of a resistor that occupies a large chip area, uses small-sized diodes, and thus increases the integration density of the band-gap reference voltage bias circuit.

In the drawings and specification, typical preferred embodiments of the invention have been disclosed and, although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A low power supply voltage band-gap reference voltage bias circuit comprising:

a first circuit generating a proportional-to-absolute temperature (PTAT) current; and a second circuit copying the PTAT current generated through the first circuit to first node and second node, respectively, to generate the first node voltage having a negative slope with respect to temperature variation and the second node voltage having a positive slope with respect to temperature variation, and serially connecting first and second elements having high impedances between the first and second nodes, so that a reference voltage between the first node and the second node is extracted, wherein a power supply voltage has value of 1V or lower and the reference voltage has a value of 0.625V with ±15% tolerance range regardless of temperature variation.

2. The circuit according to claim 1, wherein the first circuit comprises:

first and second PMOS transistors, each of which has a gate and a source respectively coupled to a third node and a power supply terminal, and drains respectively coupled to a fourth node and a fifth node;

a feedback amplifier having a non-inverting input terminal and an inverting input terminal respectively coupled to the fourth and fifth nodes, and an output terminal coupled to the third node;

a first resistor coupled between the fifth node and a sixth node; and first and second bipolar transistors, each of which has emitters respectively coupled to the fourth and sixth nodes, and a collector and a base that are grounded.

3. The circuit according to claim 2, wherein the second circuit comprises:

third and fourth PMOS transistors, each of which has a gate and a source respectively coupled to the third node and the power supply terminal, and drains respectively connected to first and second nodes, and copying the PTAT current to the first node and the second node, respectively;

a third bipolar transistor having an emitter coupled to the first node, and having a collector and a base that are grounded;

a second resistor coupled between the second node and a ground; and the first and second elements coupled in series between the first and second nodes, and having high impedance.

4. The circuit according to claim 3, wherein the reference voltage (Vref) is represented by the following equation:

$$V_{ref} \approx (V_{BE3} + R_2/R_1 \Delta V_{BE})/2$$

wherein VBE3 denotes a base-emitter voltage of the third bipolar transistor, R1 and R2 denote the first and second resistors, ΔVBE denotes a base-emitter voltage difference (VBE1−VBE2) between the first and second bipolar transistors, and VBE3 denotes a voltage having a negative slope with respect to the temperature variation, wherein the base-emitter voltage difference (ΔVBE) between the first and second bipolar transistors is a voltage having a positive slope with respect to the temperature variation.

5. The circuit according to claim 4, wherein the size of the third bipolar transistor is changed to adjust the negative slope of the base-emitter voltage (VBE3) of the third bipolar transistor so that the reference voltage (Vref) has a stable value regardless of temperature variation.

6. The circuit according to claim 4, wherein the sizes of the first and second bipolar transistors are changed to adjust the positive slope of the base-emitter voltage difference (ΔVBE) between the first and second bipolar transistor so that the reference voltage (Vref) has a stable value regardless of temperature variation.

7. The circuit according to claim 4, wherein a resistance ratio of the second resistor to the first resistor is changed to adjust the coefficient of the base-emitter voltage difference (ΔVBE) between the first and second bipolar transistors so that the reference voltage (Vref) has a stable value regardless of temperature variation.

8. The circuit according to clam 1, wherein each of the first and second elements is a diode.

* * * * *